US006568283B2

(12) United States Patent
Fanguy

(10) Patent No.: US 6,568,283 B2
(45) Date of Patent: May 27, 2003

(54) TONG WRENCH WITH TACTILE TORQUE INDICATION

(76) Inventor: Robert P. Fanguy, 3507 Captain Cade Rd., Broussard, LA (US) 70518

( * ) Notice: Subject to any disclaimer, the term of this patent is extended or adjusted under 35 U.S.C. 154(b) by 0 days.

(21) Appl. No.: 09/870,086

(22) Filed: May 29, 2001

(65) Prior Publication Data

US 2002/0139201 A1 Oct. 3, 2002

Related U.S. Application Data

(63) Continuation-in-part of application No. 09/825,535, filed on Apr. 2, 2001, now Pat. No. 6,439,064.

(51) Int. Cl.[7] ..... B25B 23/14
(52) U.S. Cl. ..... 73/862.21; 81/52.5
(58) Field of Search ..... 73/862.23, 862.25, 73/862.21, 862.27; 81/429, 467, 479

(56) References Cited

U.S. PATENT DOCUMENTS

| | | | | | |
|---|---|---|---|---|---|
| 1,334,250 | A | | 3/1920 | Langford | |
| 2,093,788 | A | | 9/1937 | Vaughn | |
| 2,442,359 | A | * | 6/1948 | Hattan | 200/52 R |
| 2,537,997 | A | * | 1/1951 | Hattan | 192/150 |
| 3,355,970 | A | * | 12/1967 | Knudsen et al. | 81/478 |
| 4,019,412 | A | * | 4/1977 | Kraus et al. | 192/46 |
| 4,027,558 | A | * | 6/1977 | Fish | 81/185 |
| 4,137,758 | A | | 2/1979 | Rodland | |
| 4,202,208 | A | * | 5/1980 | Byrne, Jr. | 73/862.25 |
| 4,257,263 | A | * | 3/1981 | Herrgen | 73/862.23 |
| 4,289,021 | A | | 9/1981 | Nelson | |
| 5,123,289 | A | * | 6/1992 | Potesta | 73/862.23 |
| 5,129,293 | A | * | 7/1992 | Larson et al. | 81/478 |
| 5,509,316 | A | | 4/1996 | Hall | |
| 5,546,816 | A | * | 8/1996 | Jansson et al. | 73/847 |
| 6,062,115 | A | * | 5/2000 | Bares et al. | 81/477 |
| 6,119,562 | A | * | 9/2000 | Jenkins | 81/479 |
| 6,234,051 | B1 | * | 5/2001 | Bareggi | 73/862.21 |

* cited by examiner

*Primary Examiner*—Hezron Williams
*Assistant Examiner*—Lilybett Martir
(74) *Attorney, Agent, or Firm*—Robert N. Montgomery

(57) ABSTRACT

A tactile torque wrench adapted for use with manual pipe tongs for gripping tubular members and the like, the torque handle adapted thereto for applying an actuating force in a manner so as to effect pivotal movement of the handle and create a tactile and audible indication to an operator when a predetermined but selectively variable torque is applied to the handle to generate the actuating force on a pipe tong and the like.

5 Claims, 2 Drawing Sheets

TONG WRENCH WITH TACTILE TORQUE INDICATION

This is a continuation-in-part of U.S. patent application Ser. No. 09/825,535 filed Apr. 2, 2001, now issued as U.S. Pat. No. 6,439,064.

BACKGROUND OF THE INVENTION

1. Field of the Invention

This invention relates generally to manually manipulated tools used for making and breaking joints between adjacent threaded tubular members and more particularly to a hand manipulated tong wrench tools adapted to an adjustable, tactile indication of the torque force being applied to the tool.

2. General Background

In the Oil and Gas industry it is common practice to make-up or couple threaded tubular members in order to provide extended strings of pipe, tubing, etc. The wrench or tool utilized to provide the torque necessary to assemble threaded tubular elements is generally known as pipe tongs. These tongs are generally a specific type of wrench or tool that typically includes a set of articulated jaws containing dies for grippingly engaging the exterior diameter of one of the adjacent threaded tubular members. The adjacent member is held stationary with respect to the member being gripped by the tong wrench and an actuating force is applied to a tong wrench handle so that the necessary torque may be applied to the gripped member to make-up or breakout the threaded interconnection.

Manually operable tongs typically may contain two or more pivotally interconnected jaw members that may be closed into gripping engagement about a threaded member in anticipation of the application of a torque thereto. When the application of the force is completed the jaws are opened so as to permit removal of the tongs from around the pipe joint. The handle is the moment arm through which the force to effect the make-up or breakout of the threaded joint between the members may be applied. Such manual tong tools may be relatively small for hand operation on small diameter threaded tubular members or relatively large for use in making-up down hole, large diameter threaded tubular members. Examples of such hand tools are disclosed in U.S. Pat. Nos. 1,334,250, 2,093,788 and 4,289,021. Manually manipulated tongs also include various types of Chain and pipe tongs. The chain tong or wrenches are usually configured to include a length of roller chain, a gripping jaw or cam portion and one or more extended handle members. Pipe tongs may include all sorts of pipe-gripping wrenches such as the opposed adjustable jaw types or fixed snap on and off ratcheting types.

Alternatively, there are arrangements known in the art as power tongs whereby the jaws are disposed in a housing circumferentially encompassing the bore opening and through which protrude the threaded members. This tong's arrangement is typically hydraulically operated and includes a tong lift arrangement whereby the tongs are raised and lowered to a predetermined operating position about a horizontal datum at which the joint to be made-up or broken-out is located. One set of jaws, (the "back-up" jaws) is then moved radially inwardly into gripping engagement with one of the members while another set of jaws (the "driven" jaws) are moved into gripping engagement with the member which is to be rotated with respect to the first. A hydraulic tongs motor or the like applies the force, which is used to affect the make-up or breakout of the joint between the adjacent threaded members.

In the case of both the manual and the power driven tongs it is advantageous to have some indication as to the magnitude of the torque applied to the threaded member. This indication has utility, for example, to prevent the application of excessive torque to the threaded member. Such torque sensing tools are disclosed in U.S. Pat. Nos. 4,137,758, 4,289,021, and 5,509,316

In the power tongs arrangement it is conventional to provide some feedback signal from the hydraulic tongs motor indicative of the amount of hydraulic pressure applied to the driven tongs. In the large diameter, manually operable tongs a suitable tension meter, load cell or the like is affixed to a cable or chain linking the end of the tong tool moment arm to a stationary element or to a force generating arrangement and thereby obtaining an indication as to the magnitude of the force applied to the handle.

It will be observed, however, that both of the above-described conventional methods are "indirect" in the sense that they provide an indication of the force applied to the end of the moment arm of the jaws distant from the end of that arm in proximity to the gripping jaws. It is believed to be equally advantageous to provide the relatively small hand or manually operated tong wrenches as described above with adjustable sensing capability disposed in the handle of the hand tong wrench, thereby providing a tactile indication of when the preset torque setting for a particular application has been achieved.

It is a conventional practice in many manufacturing processes to employ torque wrenches, which enable the tightening of threaded fasteners such as screws and bolts and the like to a predetermined tightness through the application of a predetermined torque. Torque wrenches are known which include indicators adapted to provide a visual indication to the operator of the torque being applied so that the operator does not apply a greater torque than intended. While such torque wrenches have proven satisfactory where visual observation of the indicator is unobstructed, obvious drawbacks exist where visual observation of the torque indicator is obstructed or otherwise made difficult as is the case in making-up threaded tubular members. To overcome this problem, torque wrenches have been developed which provide a non-visual indication to the operator when a predetermined torque has been reached, such as an audible "click" or a movement providing "feel" to the operator when the predetermined torque has been reached. See, for example, U.S. Pat. Nos. 2,786,378, 3,165,014, 3,577,815 and 4,467,678. However, heretofore tong type pipe wrenches have not employed such a capability.

SUMMARY OF THE INVENTION

This invention relates to a tong type pipe wrench for manually making joints between adjacent threaded tubular members such as pipe or solid, round members such as sucker rods or the like. The invention is a combination of any manually manipulated tong type tool adapted for gripping engagement of at least one threaded member of a threaded joint and a handle member connected thereto having an adjustable tactile indicating means to which a manual actuating force is applied to effect the making-up or breaking-out of the joint. In accordance with this invention, a torque wrench is adapted and calibrated to a tong type head portion and serves as the handle portion of the tong tool and is operable to generate an adjustable preset tactile indication of the force applied to the handle to effect the making-up of a joint. The manual pipe tong wrench in this case provides a non-visual indication to the operator when a predetermined torque has been reached, such as an audible "click" or a movement providing a tactile indication felt by the operator when a predetermined torque has been reached.

Typically this is achieved by providing a spherical coupling member interposed between a free end of a shank fixed to a conventional manual tong wrench head and an operating handle pivotally connected to and coaxial over the shank and carrying a follower which acts against the spherical member so as to maintain the spherical member within mutually opposed generally semispherical recesses in the shank and follower until a predetermined torque is reached, at which time the operating handle pivots relative to the shank with a resultant "click" of the shank against the inner surface of the handle to provide an audible and sensory feel indication to the operator that the predetermined torque has been reached. A means for adjustably pre-setting the biasing force applied by the follower member against the spherical coupling member provides the wrench with a torque set point.

It is therefore an object of the present invention to provide manually operated tongs with a tactile and audible indication of a preset torque when a rotary force is applied thereto.

Another object of the invention is to provide a manual tong having a means for calibrating a preset torque for pipe make-up.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENTS

Figures 1, 2:
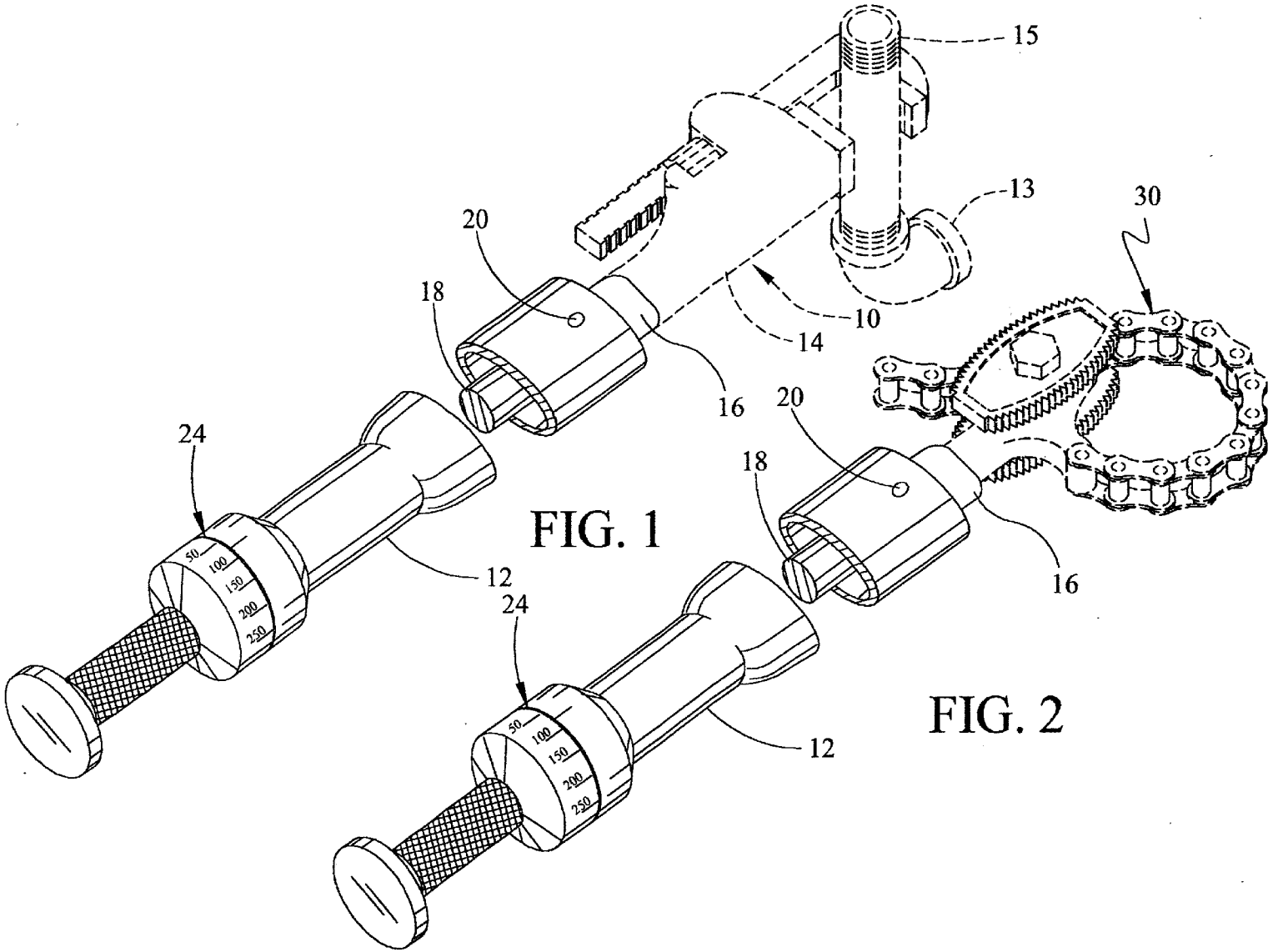
FIG. 1 is an isometric view of a first embodiment of a combination adjustable, opposed jaw pipe wrench and adjustable torque wrench.
FIG. 2 is an isometric view of a second embodiment of a combination chain tong and adjustable torque wrench.

As first illustrated in FIG. 1 the invention is a hybrid tool comprising the combination of an adjustable opposed jaw type pipe wrench assembly 10 adapted to a typical adjustable torque handle assembly 12 having a torque range of between 0–1500 ft. lbs, used primarily as a tactile and audible indication of a preset torque when making up a joint between adjacent threaded tubular members 13, 15. The handle portion 14 of pipe wrench 10 is adapted for transition to a micrometer adjustable torque wrench shank pivot member 18 having its ratchet head removed and replaced by adaptor member 16. Pivot or shank member 18 is pivotal about pin 20.

It is anticipated that the transition member 16 can take any configuration or be connected in any manner to any existing manual tong tool or incorporated into a custom built tong assembly.

The torque handle assemble 12 is typical of the type which provides a non-visual indication to the operator when a predetermined torque has been reached, such as an audible "click" or a movement providing tactile indication "feel" to the operator when a preset torque has been reached and has an adjustable dial 24 for presetting the internal spring bias for a desired torque application. The handle further defined as having a torque transfer axis and a shank portion generally coaxial therein and pivotally connected to a tubular handle, and having a coupling means releasable interconnecting said shank and handle so as to effect pivotal movement of the handle about pin 20 and create a tactile and audible indication to an operator when a predetermined but selectively variable torque is applied at said torque transfer axis in either rotational direction. The tool is generally precalibated using an electronic torque tester and calibrator.

Figure 3:
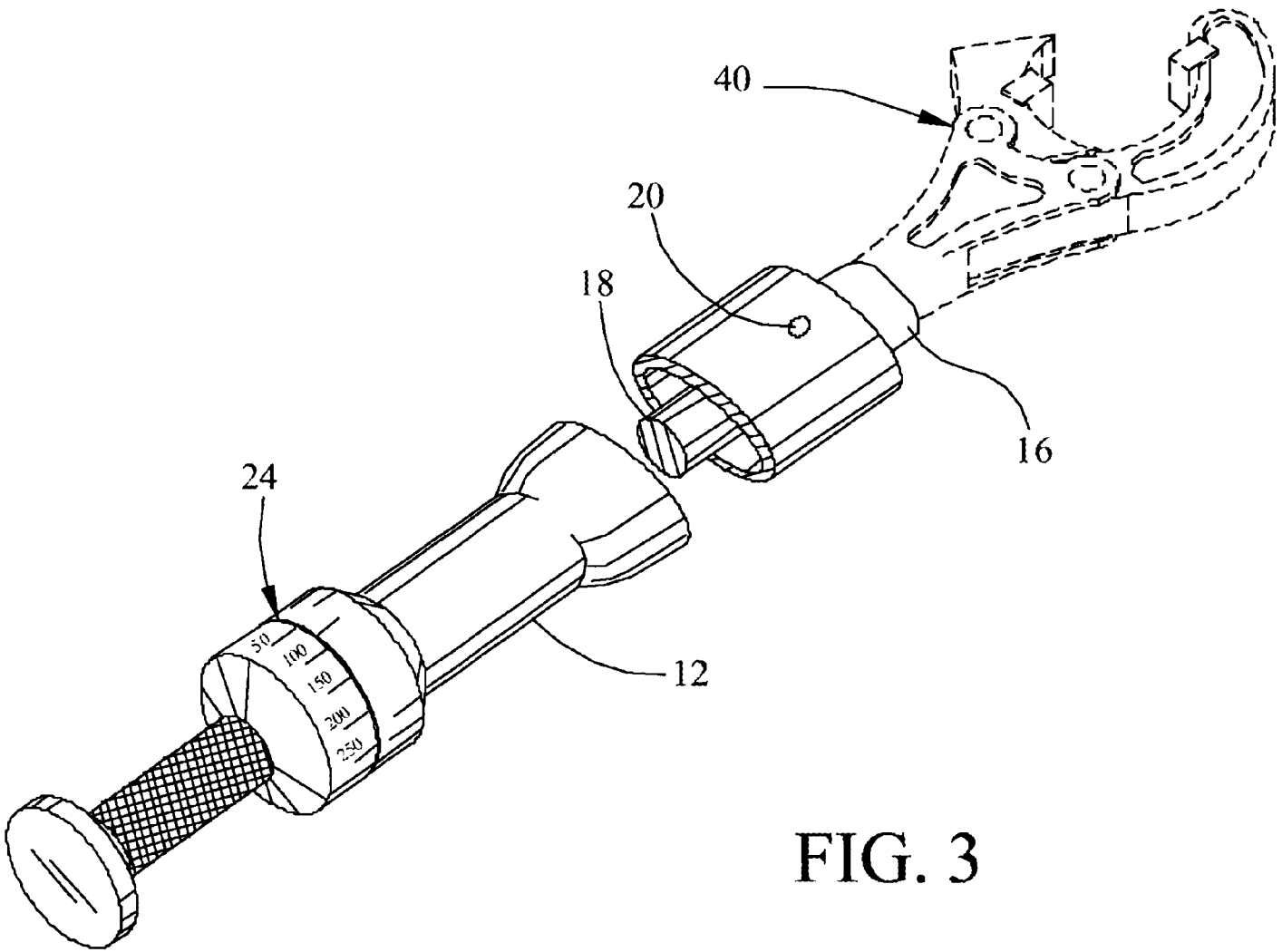
FIG. 3 is an isometric view of a third embodiment of a combination ratchet tong and adjustable torque wrench.

As seen in FIG. 2 the hybrid tool may also include a torque wrench adapted for use with a reversible chain tong tool 30 in much the same manner as seen in FIG. 1 or work equally as well when adapted to ratcheting pipe tongs 40 as shown in FIG. 3.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A hybrid tool assembly for providing a tactile and audible indication of a preset torque when making up a joint between adjacent threaded tubular members comprising:

a) a means for grippingly engaging one of said two adjacent threaded tubular members said means having a shank portion; and b) a tubular torque handle adapted to said means for grippingly engaging one of said two adjacent threaded tubular members to which an actuating force is applied to said means for grippingly engaging one of said two adjacent threaded tubular members to effect the making up of a joint, said torque handle defining a torque transfer axis perpendicular to said threaded tubular members, wherein said shank portion of said means for grippingly engaging one of said two adjacent threaded tubular members is an integral component of said torque handle located generally coaxially and pivotally connected within said tubular torque handle, and having a coupling means releasably interconnecting said shank and said torque handle so as to effect pivotal movement of said torque handle and thereby create a tactile and audible indication to an operator when a predetermined but selectively variable torque is applied at said torque transfer axis in either rotational direction.

2. The hybrid tool assembly according to claim 1 wherein said means for grippingly engaging one of two adjacent threaded tubular members is an adjustable opposed jaw pipe wrench.

3. The hybrid tool assembly according to claim 1 wherein said means for grippingly engaging one of two adjacent threaded tubular members is a chain tong.

4. The hybrid tool assembly according to claim 1 wherein said means for grippingly engaging one of two adjacent threaded tubular members is a ratchet pipe tong.

5. The hybrid tool assembly according to claim 1 wherein said torque handle is a micrometer adjustable torque wrench with the ratchet head removed.

* * * * *